US011913464B2

(12) United States Patent
Wrighton et al.

(10) Patent No.: US 11,913,464 B2
(45) Date of Patent: Feb. 27, 2024

(54) LUBRICATING AN ELECTRIC SUBMERSIBLE PUMP

(71) Applicant: Saudi Arabian Oil Company, Dhahran (SA)

(72) Inventors: Christopher Wrighton, Inverurie (GB); Sakethraman Mahalingam, Aberdeen (GB)

(73) Assignee: Saudi Arabian Oil Company, Dhahran (SA)

( * ) Notice: Subject to any disclaimer, the term of this patent is extended or adjusted under 35 U.S.C. 154(b) by 204 days.

(21) Appl. No.: 17/231,955

(22) Filed: Apr. 15, 2021

(65) Prior Publication Data

US 2022/0333608 A1 Oct. 20, 2022

(51) Int. Cl.
*F04D 29/06* (2006.01)
*F04D 1/06* (2006.01)
(Continued)

(52) U.S. Cl.
CPC ..... *F04D 29/061* (2013.01); *E21B 43/128* (2013.01); *F04D 1/06* (2013.01); *F04D 13/086* (2013.01)

(58) Field of Classification Search
CPC ..... F04D 29/061; F04D 1/06; F04D 13/086; F04D 15/0088; F04D 13/10; E21B 43/128; E21B 47/008
See application file for complete search history.

(56) References Cited

U.S. PATENT DOCUMENTS 335,164 A 2/1886 Vitalis
646,887 A 4/1900 Stowe et al.
(Continued)

FOREIGN PATENT DOCUMENTS

CA 1226325 9/1987
CA 2230691 3/2004
(Continued)

OTHER PUBLICATIONS

"Echo Dissolvable Fracturing Plug," EchoSeries, Dissolvable Fracturing Plugs, Gryphon Oilfield Solutions, Aug. 2018, 1 page.
(Continued)

*Primary Examiner* — Dominick L Plakkoottam
(74) *Attorney, Agent, or Firm* — Fish & Richardson P.C.

(57) ABSTRACT

An assembly and a method for lubricating an electric submersible pump assembly disposed in a wellbore are described. The assembly includes a pump to pressurize a wellbore fluid and an electric motor to rotate the pump. The electric motor is lubricated by a dielectric oil. A sensor is coupled to the electric motor to sense a condition of the electric motor and transmit a signal including a value representing the condition. A controller is coupled to the electric motor and the sensor. The controller receives the signal from the sensor, compares the value to a threshold value, determines when the value is greater than the threshold value, and responsive to determining that the value is greater than a threshold value indicating a presence of contaminated dielectric oil, flows a clean dielectric oil from an accumulator to the electric motor to expel the contaminated dielectric oil out of the electric motor.

15 Claims, 3 Drawing Sheets

(51) Int. Cl.
*F04D 13/08* (2006.01)
*E21B 43/12* (2006.01)

(56) References Cited

U.S. PATENT DOCUMENTS 1,559,155 A 10/1925 Bullock
1,912,452 A 6/1933 Hollander
1,978,277 A 10/1934 Noble
2,287,027 A 6/1942 Cummins
2,556,435 A 6/1951 Moehrl
2,625,110 A 1/1953 Haentjens et al.
2,641,191 A 6/1953 Alfred
2,643,723 A 6/1953 Lynes
2,782,720 A 2/1957 Dochterman
2,845,869 A 8/1958 Herbenar
2,866,417 A 12/1958 Otto
2,931,384 A 4/1960 Clark
3,007,418 A 11/1961 Brundage et al.
3,034,484 A 5/1962 Stefancin
3,038,698 A 6/1962 Troyer
3,123,010 A 3/1964 Witt et al.
3,129,875 A 4/1964 Cirillo
3,139,835 A 7/1964 Wilkinson
3,171,355 A 3/1965 Harris et al.
3,175,403 A 3/1965 Nelson
3,175,618 A 3/1965 Lang et al.
3,251,226 A 5/1966 Cushing
3,272,130 A 9/1966 Mosbacher
3,413,925 A 12/1968 Campolong
3,448,305 A 6/1969 Raynal et al.
3,516,765 A 6/1970 Boyadjieff
3,558,936 A 1/1971 Horan
3,638,732 A 2/1972 Huntsinger et al.
3,663,845 A 5/1972 Apstein
3,680,989 A 8/1972 Brundage
3,724,503 A 4/1973 Cooke
3,771,910 A 11/1973 Laing
3,795,145 A 3/1974 Miller
3,839,914 A 10/1974 Modisette et al.
3,874,812 A 4/1975 Hanagarth
3,918,520 A 11/1975 Hutchison
3,961,758 A 6/1976 Morgan
3,970,877 A 7/1976 Russell et al.
3,975,117 A 8/1976 Carter
4,025,244 A 5/1977 Sato
4,096,211 A 6/1978 Rameau
4,139,330 A 2/1979 Neal
4,154,302 A 5/1979 Cugini
4,181,175 A 1/1980 McGee et al.
4,226,275 A 10/1980 Frosch
4,266,607 A 5/1981 Halstead
4,289,199 A 9/1981 McGee
4,336,415 A 6/1982 Walling
4,374,530 A 2/1983 Walling
4,387,318 A 6/1983 Kolm et al.
4,387,685 A 6/1983 Abbey
4,417,474 A 11/1983 Elderton
4,425,965 A 1/1984 Bayh, III et al.
4,440,221 A 4/1984 Taylor et al.
4,476,923 A 10/1984 Walling
4,491,176 A 1/1985 Reed
4,497,185 A 2/1985 Shaw
4,536,674 A 8/1985 Schmidt
4,576,043 A 3/1986 Nguyen
4,580,634 A 4/1986 Cruise
4,582,131 A 4/1986 Plummer et al.
4,586,854 A 5/1986 Newman et al.
4,619,323 A 10/1986 Gidley
4,627,489 A 12/1986 Reed
4,632,187 A 12/1986 Bayh, III et al.
4,658,583 A 4/1987 Shropshire
4,662,437 A 5/1987 Renfro
4,665,981 A 5/1987 Hayatdavoudi
4,685,523 A 8/1987 Paschal, Jr. et al.
4,741,668 A 5/1988 Bearden et al.
4,757,709 A 7/1988 Czernichow
RE32,866 E 2/1989 Cruise
4,838,758 A 6/1989 Sheth
4,850,812 A 7/1989 Voight
4,856,344 A 8/1989 Hunt
4,867,633 A 9/1989 Gravelle
4,969,364 A 11/1990 Masuda
4,986,739 A 1/1991 Child
5,033,937 A 7/1991 Wilson
5,094,294 A 3/1992 Bayh, III et al.
5,113,379 A 5/1992 Scherbatskoy
5,150,619 A 9/1992 Turner
5,158,440 A 10/1992 Cooper et al.
5,169,286 A 12/1992 Yamada
5,180,014 A 1/1993 Cox
5,195,882 A 3/1993 Freeman
5,201,848 A 4/1993 Powers
5,209,650 A 5/1993 Lemieux
5,224,182 A 6/1993 Murphy et al.
5,261,796 A 11/1993 Niemiec et al.
5,269,377 A 12/1993 Martin
5,285,008 A 2/1994 Sas-Jaworsky et al.
5,301,760 A 4/1994 Graham
5,317,223 A 5/1994 Kiesewetter et al.
5,319,272 A 6/1994 Raad
5,323,661 A 6/1994 Cheng
5,334,801 A 8/1994 Mohn
5,335,542 A 8/1994 Ramakrishnan et al.
5,337,603 A 8/1994 McFarland et al.
5,358,378 A 10/1994 Holscher
5,375,622 A 12/1994 Houston
5,482,117 A 1/1996 Kolpak
5,494,413 A 2/1996 Campen et al.
5,591,922 A 1/1997 Segeral et al.
5,605,193 A 2/1997 Bearden et al.
5,613,311 A 3/1997 Burtch
5,613,555 A 3/1997 Sorem et al.
5,620,048 A 4/1997 Beauquin
5,641,915 A 6/1997 Ortiz
5,649,811 A 7/1997 Krol, Jr. et al.
5,653,585 A 8/1997 Fresco et al.
5,693,891 A 12/1997 Brown
5,708,500 A 1/1998 Anderson
5,736,650 A 4/1998 Hiron et al.
5,755,288 A 5/1998 Bearden et al.
5,834,659 A 11/1998 Ortiz
5,845,709 A 12/1998 Mack et al.
5,848,642 A 12/1998 Sola
5,880,378 A 3/1999 Behring
5,886,267 A 3/1999 Ortiz et al.
5,892,860 A 4/1999 Maron et al.
5,905,208 A 5/1999 Ortiz et al.
5,908,049 A 6/1999 Williams et al.
5,921,285 A 7/1999 Quigley et al.
5,954,305 A 9/1999 Calabro
5,965,964 A 10/1999 Skinner et al.
5,975,205 A 11/1999 Carisella
6,044,906 A 4/2000 Saltel
6,068,015 A 5/2000 Pringle
6,082,455 A 7/2000 Pringle et al.
6,113,675 A 9/2000 Branstetter
6,129,507 A 10/2000 Ganelin
6,148,866 A 11/2000 Quigley et al.
6,155,102 A 12/2000 Toma
6,164,308 A 12/2000 Butler
6,167,965 B1 1/2001 Bearden et al.
6,176,323 B1 1/2001 Weirich
6,179,269 B1 1/2001 Kobylinski et al.
6,192,983 B1 2/2001 Neuroth et al.
6,193,079 B1 2/2001 Weimer
6,209,652 B1 4/2001 Portman et al.
6,257,332 B1 7/2001 Vidrine et al.
6,264,440 B1 7/2001 Klein et al.
6,286,558 B1 9/2001 Quigley et al.
6,289,990 B1 9/2001 Dillon et al.
6,298,917 B1 10/2001 Kobylinski et al.
6,325,143 B1 12/2001 Scarsdale
6,357,485 B2 3/2002 Quigley et al.
6,361,272 B1 3/2002 Bassett

(56) References Cited

U.S. PATENT DOCUMENTS 6,413,065 B1 7/2002 Dass
6,414,239 B1 7/2002 Gasque, Jr.
6,427,778 B1 8/2002 Beall et al.
6,454,010 B1 9/2002 Thomas et al.
6,463,810 B1 10/2002 Liu
6,504,258 B2 1/2003 Schultz et al.
6,530,211 B2 3/2003 Holtzapple et al.
6,544,013 B2 4/2003 Kato et al.
6,546,812 B2 4/2003 Lewis
6,547,519 B2 4/2003 deBlanc et al.
6,550,327 B1 4/2003 Van Berk
6,557,642 B2 5/2003 Head
6,578,638 B2 6/2003 Guillory et al.
6,588,266 B2 7/2003 Tubel et al.
6,601,460 B1 8/2003 Materna
6,601,651 B2 8/2003 Grant
6,604,550 B2 8/2003 Quigley et al.
6,629,564 B1 10/2003 Ramakrishnan et al.
6,679,692 B1 1/2004 Feuling et al.
6,681,894 B1 1/2004 Fanguy
6,726,449 B2 4/2004 James et al.
6,728,165 B1 4/2004 Roscigno et al.
6,733,249 B2 5/2004 Maier et al.
6,741,000 B2 5/2004 Newcomb
6,755,609 B2 6/2004 Preinfalk
6,768,214 B2 7/2004 Schultz et al.
6,776,054 B1 8/2004 Stephenson
6,779,601 B2 8/2004 Wilson
6,807,857 B2 10/2004 Storm, Jr.
6,808,371 B2 10/2004 Niwatsukino et al.
6,811,382 B2 11/2004 Buchanan et al.
6,848,539 B2 2/2005 Lee et al.
6,856,132 B2 2/2005 Appel et al.
6,857,452 B2 2/2005 Quigley et al.
6,857,920 B2 2/2005 Marathe et al.
6,863,137 B2 3/2005 Terry et al.
6,913,079 B2 7/2005 Tubel
6,920,085 B2 7/2005 Finke et al.
6,935,189 B2 8/2005 Richards
6,993,979 B2 2/2006 Segeral
7,017,681 B2 3/2006 Ivannikov et al.
7,021,905 B2 4/2006 Torrey et al.
7,032,662 B2 4/2006 Malone et al.
7,086,294 B2 8/2006 DeLong
7,093,665 B2 8/2006 Dass
7,107,860 B2 9/2006 Jones
7,199,480 B2 4/2007 Fripp et al.
7,224,077 B2 5/2007 Allen
7,226,279 B2 6/2007 Andoskin et al.
7,242,103 B2 7/2007 Tips
7,249,805 B2 7/2007 Cap
7,259,688 B2 8/2007 Hirsch et al.
7,262,532 B2 8/2007 Seidler et al.
7,275,592 B2 10/2007 Davis
7,275,711 B1 10/2007 Flanigan
7,338,262 B2 3/2008 Gozdawa
7,345,372 B2 3/2008 Roberts et al.
7,377,312 B2 5/2008 Davis
7,410,003 B2 8/2008 Ravensbergen et al.
7,647,948 B2 1/2010 Quigley et al.
7,668,411 B2 2/2010 Davies et al.
7,670,122 B2 3/2010 Phillips et al.
7,670,451 B2 3/2010 Head
7,699,099 B2 4/2010 Bolding et al.
7,730,937 B2 6/2010 Head
7,762,715 B2 7/2010 Gordon et al.
7,770,650 B2 8/2010 Young et al.
7,775,763 B1 8/2010 Johnson et al.
7,819,640 B2 10/2010 Kalavsky et al.
7,841,395 B2 11/2010 Gay et al.
7,841,826 B1 11/2010 Phillips
7,847,421 B2 12/2010 Gardner et al.
7,849,928 B2 12/2010 Collie
7,905,295 B2 3/2011 Mack
7,906,861 B2 3/2011 Guerrero et al.
7,946,341 B2 5/2011 Hartog et al.
8,013,660 B2 9/2011 Fitzi
8,016,545 B2 9/2011 Oklejas et al.
8,047,232 B2 11/2011 Bernitsas
8,066,033 B2 11/2011 Quigley et al.
8,067,865 B2 11/2011 Savant
8,197,602 B2 6/2012 Baron
8,235,126 B2 8/2012 Bradley
8,258,644 B2 9/2012 Kaplan
8,261,841 B2 9/2012 Bailey et al.
8,302,736 B1 11/2012 Olivier
8,322,444 B2 12/2012 Camargo
8,337,142 B2 12/2012 Eslinger et al.
8,408,064 B2 4/2013 Hartog et al.
8,419,398 B2 4/2013 Kothnur et al.
8,421,251 B2 4/2013 Pabon et al.
8,426,988 B2 4/2013 Hay
8,493,556 B2 7/2013 Li et al.
8,506,257 B2 8/2013 Bottome
8,564,179 B2 10/2013 Ochoa et al.
8,568,081 B2 10/2013 Song et al.
8,579,617 B2 11/2013 Ono et al.
8,604,634 B2 12/2013 Pabon et al.
8,638,002 B2 1/2014 Lu
8,648,480 B1 2/2014 Liu et al.
8,771,499 B2 7/2014 McCutchen et al.
8,786,113 B2 7/2014 Tinnen et al.
8,821,138 B2 9/2014 Holtzapple et al.
8,905,728 B2 12/2014 Blankemeier et al.
8,916,983 B2 12/2014 Marya et al.
8,925,649 B1 1/2015 Wiebe et al.
8,932,034 B2 * 1/2015 McKinney ..... F04D 13/10 417/424.2
8,936,430 B2 1/2015 Bassett
8,948,550 B2 2/2015 Li et al.
8,950,476 B2 2/2015 Head
8,960,309 B2 2/2015 Davis
8,973,433 B2 3/2015 Mulford
9,080,336 B1 7/2015 Yantis
9,091,144 B2 7/2015 Swanson et al.
9,106,159 B1 8/2015 Wiebe et al.
9,109,429 B2 8/2015 Xu et al.
9,130,161 B2 9/2015 Nair et al.
9,133,709 B2 9/2015 Huh et al.
9,140,815 B2 9/2015 Lopez et al.
9,157,297 B2 10/2015 Williamson, Jr.
9,170,149 B2 10/2015 Hartog et al.
9,200,932 B2 12/2015 Sittler
9,203,277 B2 12/2015 Kori et al.
9,234,529 B2 1/2016 Meuter
9,239,043 B1 1/2016 Zeas
9,321,222 B2 4/2016 Childers et al.
9,322,389 B2 4/2016 Tosi
9,353,614 B2 5/2016 Roth et al.
9,383,476 B2 7/2016 Trehan
9,499,460 B2 11/2016 Kawamura et al.
9,500,073 B2 11/2016 Alan et al.
9,540,908 B1 1/2017 Olivier
9,574,438 B2 2/2017 Flores
9,581,489 B2 2/2017 Skinner
9,587,456 B2 3/2017 Roth
9,593,561 B2 3/2017 Xiao et al.
9,599,460 B2 3/2017 Wang et al.
9,599,505 B2 3/2017 Lagakos et al.
9,617,847 B2 4/2017 Jaaskelainen et al.
9,631,482 B2 4/2017 Roth et al.
9,677,560 B1 6/2017 Davis et al.
9,757,796 B2 9/2017 Sherman et al.
9,759,025 B2 9/2017 Vavik
9,759,041 B2 9/2017 Osborne
9,784,077 B2 10/2017 Gorrara
9,880,096 B2 1/2018 Bond et al.
9,903,010 B2 2/2018 Doud et al.
9,915,134 B2 3/2018 Xiao et al.
9,932,806 B2 4/2018 Stewart
9,951,598 B2 4/2018 Roth et al.
9,964,533 B2 5/2018 Ahmad
9,976,381 B2 5/2018 Martin et al.
9,982,519 B2 5/2018 Melo

(56) References Cited

U.S. PATENT DOCUMENTS 10,100,596 B2 10/2018 Roth et al.
10,115,942 B2 10/2018 Qiao et al.
10,138,885 B2 11/2018 Ejim et al.
10,151,194 B2 12/2018 Roth et al.
10,209,383 B2 2/2019 Barfoot et al.
10,253,610 B2 4/2019 Roth et al.
10,273,399 B2 4/2019 Cox et al.
10,287,853 B2 5/2019 Ejim et al.
10,308,865 B2 6/2019 Cox et al.
10,323,641 B2 6/2019 Tanner et al.
10,323,644 B1 6/2019 Shakirov et al.
10,337,302 B2 * 7/2019 Roth ..... E21B 43/128
10,337,312 B2 7/2019 Xiao et al.
10,352,125 B2 7/2019 Frazier
10,367,434 B2 7/2019 Ahmad
10,378,322 B2 8/2019 Ejim et al.
10,465,477 B2 11/2019 Abdelaziz et al.
10,465,484 B2 11/2019 Turner et al.
10,487,259 B2 11/2019 Cox et al.
10,501,682 B2 12/2019 Cox et al.
10,533,558 B2 1/2020 Melo et al.
10,578,111 B2 3/2020 Xiao et al.
2001/0036334 A1 11/2001 Choa
2002/0043404 A1 4/2002 Trueman et al.
2002/0074742 A1 6/2002 Quoiani
2002/0079100 A1 6/2002 Simpson
2002/0109080 A1 8/2002 Tubel et al.
2002/0121376 A1 9/2002 Rivas
2002/0153141 A1 10/2002 Hartman
2003/0079880 A1 5/2003 Deaton et al.
2003/0141071 A1 7/2003 Hosie
2003/0161739 A1 8/2003 Chu et al.
2003/0185676 A1 10/2003 James
2003/0226395 A1 12/2003 Storm et al.
2004/0060705 A1 4/2004 Kelley
2005/0047779 A1 3/2005 Jaynes et al.
2005/0098349 A1 5/2005 Krueger et al.
2005/0166961 A1 8/2005 Means
2005/0217859 A1 10/2005 Hartman
2006/0076956 A1 4/2006 Sjolie et al.
2006/0086498 A1 4/2006 Wetzel et al.
2006/0090892 A1 * 5/2006 Wetzel ..... E21B 47/10
166/250.01
2006/0096760 A1 5/2006 Ohmer
2007/0012437 A1 1/2007 Clingman et al.
2007/0181304 A1 8/2007 Rankin et al.
2007/0193749 A1 8/2007 Folk
2008/0048455 A1 2/2008 Carney
2008/0093084 A1 4/2008 Knight
2008/0100828 A1 5/2008 Cyr et al.
2008/0187434 A1 8/2008 Neiszer
2008/0236842 A1 10/2008 Bhavsar et al.
2008/0262737 A1 10/2008 Thigpen et al.
2008/0264182 A1 10/2008 Jones
2008/0277941 A1 11/2008 Bowles
2008/0290876 A1 11/2008 Ameen
2008/0292454 A1 11/2008 Brunner
2009/0001304 A1 1/2009 Hansen et al.
2009/0016899 A1 1/2009 Davis
2009/0090513 A1 4/2009 Bissonnette
2009/0110579 A1 4/2009 Amburgey
2009/0151928 A1 6/2009 Lawson
2009/0151953 A1 6/2009 Brown
2009/0166045 A1 7/2009 Wetzel et al.
2009/0255669 A1 10/2009 Ayan et al.
2009/0304322 A1 10/2009 Davies et al.
2009/0289627 A1 11/2009 Johansen et al.
2009/0293634 A1 12/2009 Ong
2010/0040492 A1 2/2010 Eslinger et al.
2010/0122818 A1 5/2010 Rooks
2010/0164231 A1 7/2010 Tsou
2010/0206577 A1 8/2010 Martinez
2010/0236794 A1 9/2010 Duan
2010/0244404 A1 9/2010 Bradley
2010/0258306 A1 10/2010 Camilleri
2010/0288493 A1 11/2010 Fielder et al.
2010/0300413 A1 12/2010 Ulrey et al.
2010/0308592 A1 12/2010 Frayne
2011/0017459 A1 1/2011 Dinkins
2011/0024107 A1 2/2011 Sunyovszky et al.
2011/0024231 A1 2/2011 Wurth et al.
2011/0036568 A1 2/2011 Barbosa
2011/0036662 A1 2/2011 Smith
2011/0049901 A1 3/2011 Tinnen
2011/0088462 A1 4/2011 Samson et al.
2011/0155390 A1 6/2011 Lannom et al.
2011/0162832 A1 7/2011 Reid
2011/0169353 A1 7/2011 Endo
2011/0185805 A1 8/2011 Roux et al.
2011/0203848 A1 8/2011 Krueger et al.
2011/0273032 A1 11/2011 Lu
2011/0278094 A1 11/2011 Gute
2011/0296911 A1 12/2011 Moore
2011/0300008 A1 12/2011 Fielder et al.
2012/0012327 A1 1/2012 Plunkett et al.
2012/0018143 A1 1/2012 Lembcke
2012/0211245 A1 8/2012 Fuhst et al.
2012/0282119 A1 11/2012 Floyd
2012/0292915 A1 11/2012 Moon
2013/0019673 A1 1/2013 Sroka
2013/0300833 A1 1/2013 Perkins
2013/0048302 A1 2/2013 Gokdag et al.
2013/0051977 A1 2/2013 Song
2013/0066139 A1 3/2013 Wiessler
2013/0068454 A1 3/2013 Armistead
2013/0068481 A1 3/2013 Zhou
2013/0073208 A1 3/2013 Dorovsky
2013/0081460 A1 4/2013 Xiao et al.
2013/0091942 A1 4/2013 Samson et al.
2013/0119669 A1 5/2013 Murphree
2013/0119830 A1 5/2013 Hautz
2013/0167628 A1 7/2013 Hull et al.
2013/0175030 A1 7/2013 Ige
2013/0189123 A1 7/2013 Stokley
2013/0200628 A1 8/2013 Kane
2013/0213663 A1 8/2013 Lau et al.
2013/0227940 A1 9/2013 Greenblatt
2013/0248429 A1 9/2013 Dahule
2013/0255370 A1 10/2013 Roux et al.
2013/0259721 A1 10/2013 Noui-Mehidi
2013/0272898 A1 10/2013 Toh et al.
2014/0012507 A1 1/2014 Trehan
2014/0014331 A1 1/2014 Crocker
2014/0027546 A1 1/2014 Kean et al.
2014/0037422 A1 2/2014 Gilarranz
2014/0041862 A1 2/2014 Ersoz
2014/0116720 A1 5/2014 He et al.
2014/0144706 A1 5/2014 Bailey et al.
2014/0167418 A1 6/2014 Hiejima
2014/0175800 A1 6/2014 Thorp
2014/0208855 A1 7/2014 Skinner
2014/0209291 A1 7/2014 Watson et al.
2014/0265337 A1 9/2014 Harding et al.
2014/0284937 A1 9/2014 Dudley et al.
2014/0311737 A1 10/2014 Bedouet et al.
2014/0341714 A1 11/2014 Casa
2014/0343857 A1 11/2014 Pfutzner
2014/0377080 A1 12/2014 Xiao et al.
2015/0034580 A1 2/2015 Nakao et al.
2015/0068769 A1 3/2015 Xiao et al.
2015/0071795 A1 3/2015 Vazquez et al.
2015/0114127 A1 4/2015 Barfoot et al.
2015/0192141 A1 7/2015 Nowitzki et al.
2015/0233228 A1 8/2015 Roth
2015/0308245 A1 10/2015 Stewart et al.
2015/0308444 A1 10/2015 Trottman
2015/0318920 A1 11/2015 Johnston
2015/0323130 A1 * 11/2015 Meyer ..... F16N 17/00
184/6.1
2015/0330194 A1 11/2015 June et al.
2015/0354308 A1 12/2015 June et al.
2015/0354590 A1 12/2015 Kao
2015/0376907 A1 12/2015 Nguyen
2016/0010451 A1 1/2016 Melo

(56) References Cited

U.S. PATENT DOCUMENTS

| | | | |
|---|---|---|---|
| 2016/0016834 | A1 | 1/2016 | Dahule |
| 2016/0164377 | A1 | 6/2016 | Gauthier |
| 2016/0168957 | A1 | 6/2016 | Tubel |
| 2016/0169231 | A1 | 6/2016 | Michelassi et al. |
| 2016/0177659 | A1 | 6/2016 | Voll et al. |
| 2016/0273947 | A1 | 9/2016 | Mu et al. |
| 2016/0305447 | A1 | 10/2016 | Dreiss et al. |
| 2016/0332856 | A1 | 11/2016 | Steedley |
| 2017/0033713 | A1 | 2/2017 | Petroni |
| 2017/0038246 | A1 | 2/2017 | Coates et al. |
| 2017/0058664 | A1 | 3/2017 | Xiao et al. |
| 2017/0074082 | A1 | 3/2017 | Palmer |
| 2017/0075029 | A1 | 3/2017 | Cuny et al. |
| 2017/0122046 | A1 | 5/2017 | Vavik |
| 2017/0138189 | A1 | 5/2017 | Ahmad et al. |
| 2017/0159668 | A1 | 6/2017 | Nowitzki et al. |
| 2017/0167498 | A1 | 6/2017 | Chang |
| 2017/0175752 | A1 | 6/2017 | Hofer et al. |
| 2017/0183942 | A1 | 6/2017 | Veland |
| 2017/0194831 | A1 | 7/2017 | Marvel |
| 2017/0235006 | A1 | 8/2017 | Ellmauthaler et al. |
| 2017/0260846 | A1 | 9/2017 | Jin et al. |
| 2017/0292533 | A1 | 10/2017 | Zia |
| 2017/0321695 | A1 | 11/2017 | Head |
| 2017/0328151 | A1 | 11/2017 | Dillard |
| 2017/0343006 | A1 | 11/2017 | Ehrsann |
| 2017/0346371 | A1 | 11/2017 | Gruetzner |
| 2018/0045543 | A1 | 2/2018 | Farhadiroushan et al. |
| 2018/0052041 | A1 | 2/2018 | Yaman et al. |
| 2018/0058157 | A1 | 3/2018 | Melo et al. |
| 2018/0066671 | A1 | 3/2018 | Murugan |
| 2018/0128661 | A1 | 5/2018 | Munro |
| 2018/0134036 | A1 | 5/2018 | Galtarossa et al. |
| 2018/0155991 | A1 | 6/2018 | Arsalan et al. |
| 2018/0171763 | A1 | 6/2018 | Malbrel et al. |
| 2018/0171767 | A1 | 6/2018 | Huynh et al. |
| 2018/0172020 | A1 | 6/2018 | Ejim |
| 2018/0202843 | A1 | 7/2018 | Artuso et al. |
| 2018/0226174 | A1 | 8/2018 | Rose |
| 2018/0238152 | A1 | 8/2018 | Melo |
| 2018/0274311 | A1 | 9/2018 | Zsolt |
| 2018/0284304 | A1 | 10/2018 | Barfoot et al. |
| 2018/0306199 | A1 | 10/2018 | Reed |
| 2018/0320059 | A1 | 11/2018 | Cox et al. |
| 2018/0340389 | A1 | 11/2018 | Wang |
| 2018/0351480 | A1 | 12/2018 | Ahmad |
| 2018/0363660 | A1 | 12/2018 | Klahn |
| 2019/0025095 | A1 | 1/2019 | Steel |
| 2019/0032667 | A1 | 1/2019 | Ifrim et al. |
| 2019/0040863 | A1 | 2/2019 | Davis et al. |
| 2019/0049054 | A1 | 2/2019 | Gunnarsson |
| 2019/0128113 | A1 | 5/2019 | Ross et al. |
| 2019/0253003 | A1 | 8/2019 | Ahmad |
| 2019/0253004 | A1 | 8/2019 | Ahmad |
| 2019/0253005 | A1 | 8/2019 | Ahmad |
| 2019/0253006 | A1 | 8/2019 | Ahmad |
| 2019/0271217 | A1 | 9/2019 | Radov et al. |
| 2019/0368291 | A1 | 12/2019 | Xiao et al. |
| 2019/0376371 | A1 | 12/2019 | Arsalan |
| 2020/0056462 | A1 | 2/2020 | Xiao et al. |
| 2020/0056615 | A1 | 2/2020 | Xiao et al. |
| 2020/0220431 | A1 | 7/2020 | Wrighton |

FOREIGN PATENT DOCUMENTS

| | | |
|---|---|---|
| CA | 2629578 | 10/2009 |
| CN | 2168104 | 6/1994 |
| CN | 1507531 | 6/2004 |
| CN | 101328769 | 12/2008 |
| CN | 101592475 | 12/2009 |
| CN | 201496028 | 6/2010 |
| CN | 101842547 | 9/2010 |
| CN | 102471701 | 5/2012 |
| CN | 101488805 | 8/2012 |
| CN | 202851445 | 4/2013 |
| CN | 103185025 | 7/2013 |
| CN | 203420906 | 2/2014 |
| CN | 103913186 | 7/2014 |
| CN | 104141633 | 11/2014 |
| CN | 104533797 | 4/2015 |
| CN | 105043586 | 11/2015 |
| CN | 103835988 | 1/2016 |
| CN | 105239963 | 1/2016 |
| CN | 103717901 | 6/2016 |
| CN | 107144339 | 9/2017 |
| CN | 206496768 | 9/2017 |
| CN | 105371943 | 6/2018 |
| CN | 107664541 | 6/2018 |
| CN | 108534910 | 9/2018 |
| DE | 2260678 | 6/1974 |
| DE | 3022241 | 12/1981 |
| DE | 3444859 | 6/1985 |
| DE | 3520884 | 1/1986 |
| DE | 19654092 | 7/1998 |
| DE | 10307887 | 10/2004 |
| DE | 102007005426 | 5/2008 |
| DE | 102008001607 | 11/2009 |
| DE | 102008054766 | 6/2010 |
| DE | 202012103729 | 10/2012 |
| DE | 102012215023 | 1/2014 |
| DE | 102012022453 | 5/2014 |
| DE | 102013200450 | 7/2014 |
| DE | 102012205757 | 8/2014 |
| EP | 0380148 | 8/1990 |
| EP | 0579981 | 1/1994 |
| EP | 0637675 | 2/1995 |
| EP | 1101024 | 5/2001 |
| EP | 1143104 | 10/2001 |
| EP | 1270900 | 1/2003 |
| EP | 1369588 | 12/2003 |
| EP | 2801696 | 12/2014 |
| EP | 2893301 | 5/2018 |
| EP | 3527830 | 8/2019 |
| GB | 670206 | 4/1952 |
| GB | 2173034 | 10/1986 |
| GB | 2218721 | 11/1989 |
| GB | 2226776 | 7/1990 |
| GB | 2283035 | 4/1995 |
| GB | 2313445 | 11/1997 |
| GB | 2348674 | 10/2000 |
| GB | 2477909 | 8/2011 |
| GB | 2504104 | 1/2014 |
| JP | 4019375 | 1/1992 |
| JP | 2005076486 | 3/2005 |
| JP | 2010156172 | 7/2010 |
| JP | 2013110910 | 6/2013 |
| RU | 98500 | 10/2010 |
| RU | 122531 | 11/2012 |
| RU | 178531 | 4/2018 |
| WO | WO 1993006331 | 4/1993 |
| WO | WO 1995004869 | 2/1995 |
| WO | WO 1998046857 | 10/1998 |
| WO | WO 1999027256 | 6/1999 |
| WO | WO 2002072998 | 9/2002 |
| WO | WO 2005066502 | 7/2005 |
| WO | WO 2009046709 | 4/2009 |
| WO | WO 2009113894 | 9/2009 |
| WO | WO 2009129607 | 10/2009 |
| WO | WO 2011066050 | 6/2011 |
| WO | WO 2011101296 | 8/2011 |
| WO | WO 2011133620 | 10/2011 |
| WO | WO 2011135541 | 11/2011 |
| WO | WO 2012058290 | 5/2012 |
| WO | WO 2012166638 | 12/2012 |
| WO | WO 2013089746 | 6/2013 |
| WO | WO 2013171053 | 11/2013 |
| WO | WO 2014116458 | 7/2014 |
| WO | WO 2014127035 | 8/2014 |
| WO | WO 2014147645 | 9/2014 |
| WO | WO 2015034482 | 3/2015 |
| WO | WO 2015041655 | 3/2015 |
| WO | WO 2015073018 | 5/2015 |
| WO | WO 2015084926 | 6/2015 |
| WO | WO 2015123236 | 8/2015 |

(56) References Cited

FOREIGN PATENT DOCUMENTS

| | | |
|---|---|---|
| WO | WO 2016003662 | 1/2016 |
| WO | WO 2016012245 | 1/2016 |
| WO | WO 2016050301 | 4/2016 |
| WO | WO 2016081389 | 5/2016 |
| WO | WO 2016089526 | 6/2016 |
| WO | WO 2016111849 | 7/2016 |
| WO | WO 2016130620 | 8/2016 |
| WO | WO 2016160016 | 10/2016 |
| WO | WO 2016195643 | 12/2016 |
| WO | WO 2017021553 | 2/2017 |
| WO | WO 2017023320 | 2/2017 |
| WO | WO 2017146593 | 8/2017 |
| WO | WO 2018022198 | 2/2018 |
| WO | WO 2018096345 | 5/2018 |
| WO | WO 2018125071 | 7/2018 |
| WO | WO 2018145215 | 8/2018 |
| WO | WO 2019243789 | 12/2019 |

OTHER PUBLICATIONS

"TervAlloy Degradable Magnesium Alloys," Terves Engineered Response, Engineered for Enhanced Completion Efficiency, Feb. 2018, 8 pages.

Abelsson et al., "Development and Testing of a Hybrid Boosting Pump," OTC 21516, Offshore Technology Conference, presented at the Offshore Technology Conference, May 2-5, 2011, 9 pages.

Alhanati et al., "ESP Failures: Can we talk the same language?" SPE paper, SPE ESP Workshop held in Houston, Apr. 25-27, 2001, 11 page.

Alhasan et al., "Extending mature field production life using a multiphase twin screw pump," BHR Group Multiphase 15, 2011, 11 pages.

Baker Hughes, "Multiphase Pump: Increases Efficiency and Production in Wells with High Gas Content," Brochure overview, retrieved from URL <https://assets.www.bakerhughes.com/system/69/00d970d9dd11e3a411ddf3c1325ea6/28592.MVP_Overview.pdf>, 2014, 2 pages.

Bao et al., "Recent development in the distributed fiber optic acoustic and ultrasonic detection," Journal of Lightwave Technology 35:16, Aug. 15, 2017, 12 pages.

Blunt, "Effects of heterogeneity and wetting on relative permeability using pore level modeling," SPE 36762, Society of Petroleum Engineers (SPE), SPE Journal 2:01 (70-87), Mar. 1997, 19 pages.

Bryant and Blunt, "Prediction of relative permeability in simple porous media," Physical Review A 46:4, Aug. 1992, 8 pages.

Bybee et al., "Through-Tubing Completions Maximize Production," SPE-0206-0057, Society of Petroleum Engineers (SPE), Drilling and Cementing Technology, JPT, Feb. 2006, 2 pages.

Champion et al., "The application of high-power sound waves for wellbore cleaning, " SPE 82197, Society of Petroleum Engineers International (SPE), presented at the SPE European Formation Damage Conference, May 13-14, 2003, 10 pages.

Chappell and Lancaster, "Comparison of methodological uncertainties within permeability measurements," Wiley InterScience, Hydrological Processes 21:18 (2504-2514), Jan. 2007, 11 pages.

Chen et al., "Distributed acoustic sensor based on two-mode fiber," Optics Express, 26:19, Sep. 17, 2018, 9 pages.

Corona et al., "Novel Washpipe-Free ICD Completion With Dissolvable Material," OTC-28863-MS, Offshore Technology Conference (OTC), presented at the Offshore Technology Conference, April 30-May 3, 2018, 10 pages.

Cox et al., "Realistic Assessment of Proppant Pack Conductivity for Material Section," SPE-84306-MS, Society of Petroleum Engineers (SPE), presented at the SPE Annual Technical Conference and Exhibition, Oct. 5-8, 2003, 12 pages.

Cramer et al., "Development and Application of a Downhole Chemical Injection Pump for Use in ESP Applications," SPE 14403, Society of Petroleum Engineers (SPE), presented at the 66th Annual Technical Conference and Exhibition, Sep. 22-25, 1985, 6 page.

Danfoss, "Facts Worth Knowing about Frequency Converters," Handbook VLT Frequency Converters, Danfoss Engineering Tomorrow, 180 pages.

DiCarlo et al., "Three-phase relative permeability of water-wet, oil-wet, and mixed-wet sandpacks," SPE 60767, Society of Petroleum Engineers (SPE), presented at the 1998 SPE Annual Technical Conference and Exhibition, Sep. 27-30, 1998, SPE Journal 5:01 (82-91), Mar. 2000, 10 pages.

Dixit et al., "A pore-level investigation of relative permeability hysteresis in water-wet systems," SPE 37233, Society of Petroleum Engineers (SPE), presented at the 1997 SPE International Symposium on Oilfield Chemistry, Feb. 18-21, 1997, SPE Journal 3:02 (115-123), Jun. 1998, 9 pages.

Ejprescott.com (online), "Water, Sewer and Drain Fittings B-22, Flange Adaptors," retrieved from URL <https://www.ejprescott.com/media/reference/FlangeAdaptorsB-22.pdf> retrieved on Jun. 15, 2020, available on or before Nov. 2010 via wayback machine URL <http://web.archive.org/web/20101128181255/https://www.ejprescott.com/media/reference/FlangeAdaptorsB-22.pdf>, 5 pages.

Fatt, "The network model of porous media," SPE 574-G, I. Capillary Pressure Characteristics, AIME Petroleum Transactions 207: 144-181, Dec. 1956, 38 pages.

Fornarelli et al., "Flow patterns and heat transfer around six in-line circular cylinders at low Reynolds number," JP Journal of Heat and Mass Transfer, Pushpa Publishing House, Allahabad, India, Feb. 2015, 11:1 (1-28), 28 pages.

Geary et al., "Downhole Pressure Boosting in Natural Gas Wells: Results from Prototype Testing," SPE 11406, Society of Petroleum Engineers International (SPE), presented at the SPE Asia Pacific Oil and Gas Conference and Exhibition, Oct. 20-22, 2008, 13 pages.

Gillard et al., "A New Approach to Generating Fracture Conductivity," SPE-135034-MS, Society of Petroleum Engineers (SPE), presented at the SPE Annual Technical Conference and Exhibition, Sep. 20-22, 2010, 14 pages.

Godbole et al., "Axial Thrust in Centrifugal Pumps—Experimental Analysis," Paper Ref: 2977, presented at the 15th International Conference on Experimental Mechanics, ICEM15, Jul. 22-27, 2012, 14 pages.

Gomaa et al., "Computational Fluid Dynamics Applied To Investigate Development and Optimization of Highly Conductive Channels within the Fracture Geometry," SPE-179143-MS, Society of Petroleum Engineers (SPE), SPE Production & Operations, 32:04, Nov. 2017, 12 pages.

Gomaa et al., "Improving Fracture Conductivity by Developing and Optimizing a Channels Within the Fracture Geometry: CFD Study," SPE-178982-MS, Society of Petroleum Engineers (SPE), presented at the SPE International Conference and Exhibition on Formation Damage Control, Feb. 24-26, 2016, 25 pages.

Govardhan et al., "Critical mass in vortex-induced vibration of a cylinder," European Journal of Mechanics B/Fluids, Jan.-Feb. 2004, 23:1 (17-27), 11 pages.

Heiba et al., "Percolation theory of two-phase relative permeability," SPE Reservoir Engineering 7:01 (123-132), Feb. 1992, 11 pages.

Hua et al., "Comparison of Multiphase Pumping Techniques for Subsea and Downhole Applications," SPE 146784, Society of Petroleum Engineers International (SPE), presented at the SPE Annual Technical Conference and Exhibition, Oct. 30-Nov. 2, 2011, Oil and Gas Facilities, Feb. 2012, 11 pages.

Hui and Blunt, "Effects of wettability on three-phase flow in porous media" American Chemical Society (ACS), J. Phys. Chem. 104 :16 (3833-3845), Feb. 2000, 13 pages.

Juarez and Taylor, "Field test of a distributed fiber-optic intrusion sensor system for long perimeters," Applied Optics 46:11, Apr. 10, 2007, 4 pages.

Keiser, "Optical fiber communications," 26-57, McGraw Hill, 2008, 16 pages.

Kern et al., "Propping Fractures With Aluminum Particles," SPE-1573-G-PA, Society of Petroleum Engineers (SPE), Journal of Per. Technology, 13:6 (583-589), Jun. 1961, 7 pages.

Krag et al., "Preventing Scale Deposition Downhole Using High Frequency Electromagnetic AC Signals from Surface Enhance Production Offshore Denmark," SPE-170898-MS, Society of Petro-

(56) References Cited

OTHER PUBLICATIONS leum Engineers International (SPE), presented at the SPE Annual Technical Conference and Exhibition, Oct. 27-29, 2014, 10 pages.
Laserfocusworld.com [online], "High-Power Lasers: Fiber lasers drill for oil," Dec. 5, 2012, retrieved on May 31, 2018, retrieved from URL: <https://www.laserfocusworld.com/articles/print/volume-48/issue-12/world-news/high-power-lasers-fiber-lasers-drill-for-oil.html>, 4 pages.
Li et al., "In Situ Estimation of Relative Permeability from Resistivity Measurements," EAGE/The Geological Society of London, Petroleum Geoscience 20: 143-151, 2014, 10 pages.
Machinedesign.com [online], Frances Richards, "Motors for efficiency: Permanent-magnet, reluctance, and induction motors compared," Apr. 2013, retrieved on Nov. 11, 2020, retrieved from URL <https://www.machinedesign.com/motors-drives/article/21832406/motors-for-efficiency-permanentmagnet-reluctance-and-induction-motors-compared>.
Mahmud et al., "Effect of network topology on two-phase imbibition relative permeability," Transport in Porous Media 66:3 (481-493), Feb. 2007, 14 pages.
Meyer et al., "Theoretical Foundation and Design Formulae for Channel and Pillar Type Propped Fractures—A Method to Increase Fracture Conductivity," SPE-170781-MS, Society of Petroleum Engineers (SPE), presented at the SPE Annual Technical Conference and Exhibition, Oct. 27-29, 2014, 25 pages.
Mirza, "The Next Generation of Progressive Cavity Multiphase Pumps use a Novel Design Concept for Superior Performance and Wet Gas Compression," Flow Loop Testing, BHR Group, 2007, 9 pages.
Mirza, "Three Generations of Multiphase Progressive Cavity Pumping," Cahaba Media Group, Upstream Pumping Solutions, Winter 2012, 6 pages.
Muswar et al., " Physical Water Treatment in the Oil Field Results from Indonesia," SPE 113526, Society of Petroleum Engineers International (SPE), presented at the SPE Asia Pacific Oil and Gas Conference and Exhibition, Oct. 18-20, 2010, 11 pages.
Nagy et al., "Comparison of permeability testing methods," Proceedings of the 18th International Conference on Soil Mechanics and Geotechnical Engineering 399-402, 2013, 4 pages.
Palisch et al., "Determining Realistic Fracture Conductivity and Understanding its Impact on Well Performance—Theory and Field Examples," SPE-106301-MS, Society of Petroleum Engineers (SPE), presented at the 2007 SPE Hydraulic Fracturing Technology Conference, Jan. 29-31, 2007, 13 pages.
Parker, "About Gerotors," Parker Haffinfin Corp, 2008, 2 pages.
Poollen et al., "Hydraulic Fracturing—FractureFlow Capacity vs Well Productivity," SPE-890-G, Society of Petroleum Engineers (SPE), presented at 32nd Annual Fall Meeting of Society of Petroleum Engineers, Oct. 6-9, 1957, published as Petroleum Transactions AIME 213, 1958, 5 pages.
Poollen, "Productivity vs Permeability Damage in Hydraulically Produced Fractures," Paper 906-2-G, American Petroleum Institute, presented at Drilling and Production Practice, Jan. 1, 1957, 8 pages.
Purcell, "Capillary pressures—their measurement using mercury and the calculation of permeability therefrom," Petroleum Transactions, AIME, presented at the Branch Fall Meeting, Oct. 4-6, 1948, Journal of Petroleum Technology 1:02 (39-48), Feb. 1949, 10 pages.
Qin et al., "Signal-to-Noise Ratio Enhancement Based on Empirical Mode Decomposition in Phase-Sensitive Optical Time Domain Reflectometry Systems," Sensors, MDPI, 17:1870, Aug. 14, 2017, 10 pages.
Rzeznik et al., "Two Year Results of a Breakthrough Physical Water Treating System for the Control of Scale in Oilfield Applications," SPE114072, Society of Petroleum Engineers International (SPE), presented at the 2008 SPE International Oilfield Scale Conference, May 28-29, 2008, 11 pages.
Schlumberger, "AGH: Advanced Gas-Handling Device," Product Sheet, retrieved from URL: <http://www.slb.com/~/media/Files/artificial_lift/product_sheets/ESPs/advanced_gas_handling_ps.pdf>, Jan. 2014, 2 pages.
Schöneberg, "Wet Gas Compression with Twin Screw Pumps," Bornemann Pumps, Calgary Pump Symposium 2005, 50 pages.
Simpson et al., "A Touch, Truly Multiphase Downhole Pump for Unconventional Wells," SPE-185152-MS, Society of Petroleum Engineers (SPE), presented at the SPE Electric Submersible Pump Symposium, the Woodlands, Texas, Apr. 24-28, 2017, 20 pages.
Sulzer Technical Review, "Pushing the Boundaries of Centrifugal Pump Design," Oil and Gas, Jan. 2014, 2 pages.
Takahashi et al., "Degradation Study on Materials for Dissolvable Frac Plugs," URTEC-2901283-MS, Unconventional Resources Technology Conference (URTC), presented at the SPE/AAPG/SEG Unconventional Resources Technology Conference, Jul. 23-25, 2018, 9 pages.
Tinsley and Williams, "A new method for providing increased fracture conductivity and improving stimulation results," SPE-4676-PA, Society of Petroleum Engineers (SPE), Journal of Petroleum Technology, 27:11, Nov. 1975, 7 pages.
Tm4.com [online], "Outer rotor for greater performance," available on or before Dec. 5, 2017, via internet archive: Wayback Machine URL <https://web.archive.org/web/20171205163856/https://www.tm4.com/technology/electric-motors/external-rotor-motor-technology/>, retrieved on May 17, 2017, retrieved from URL <https://www.tm4.com/technology/electric-motors/external-rotor-motor-technology/>, 2 pages.
Vincent, "Examining Our Assumptions—Have Oversimplifications Jeopardized our Ability To Design Optimal Fracture Treatments," SPE-119143-MS, Society of Petroleum Engineers (SPE), presented at the 2009 SPE Hydraulic Fracturing Technology Conference, Jan. 19-21, 2009, 51 pages.
Vincent, "Five Things You Didn't Want to Know about Hydraulic Fractures," ISRM-ICHF-2013-045, presented at the International Conference for Effective and Sustainable Hydraulic Fracturing: An ISRM specialized Conference, May 20-22, 2013, 14 pages.
Vysloukh, "Chapter 8: Stimulated Raman Scattering," 298-302, in Nonlinear Fiber Optics, 1990, 5 pages.
Walker et al., "Proppants, We Don't Need No Proppants—A Perspective of Several Operators," SPE-38611-MS, Society of Petroleum Engineers (SPE), presented at the 1997 Annual Technical Conference and Exhibition, Oct. 5-8, 1997, 8 pages.
Wang et al., "Rayleigh scattering in few-mode optical fibers," Scientific reports, 6:35844, Oct. 2016, 8 pages.
Wylde et al., "Deep Downhole Chemical Injection on BP-Operated Miller: Experience and Learning," SPE 92832, Society of Petroleum Engineers (SPE), presented at the 2005 SPE International Symposium on Oilfield Chemistry, May 11-12, 2005, SPE Production & Operations, May 2006, 6 pages.
Xiao et al., "Induction Versus Permanent Magnet Motors for ESP Applications," SPE-192177-MS, Society of Petroleum Engineers (SPE), presented at the SPE Kingdom of Saudi Arabia Annual Technical Symposium and Exhibition, Apr. 23-26, 2018, 15 pages.
Yamate et al., "Optical Sensors for the Exploration of Oil and Gas," Journal of Lightwave Technology 35:16, Aug. 15, 2017, 8 pages.
Yu et al., "Borehole seismic survey using multimode optical fibers in a hybrid wireline," Measurement, Sep. 2018, 125:694-703, 10 pages.
Zhan et al., "Characterization of Reservoir Heterogeneity Through Fluid Movement Monitoring with Deep Electromagnetic and Pressure Measurements," SPE 116328, Society of Petroleum Engineers International (SPE), presented at the 2008 SPE Annual Technical Conference and Exhibition, Sep. 21-24, 2008, 16 pages.
SAIP Examination Report in Saudi Arabian Appln. No. 122430932, dated Mar. 19, 2023, with English Translation, 9 pages.

* cited by examiner

LUBRICATING AN ELECTRIC SUBMERSIBLE PUMP

TECHNICAL FIELD

This disclosure relates to an electric submersible pump in a wellbore, for example, one through which hydrocarbons or water are produced.

BACKGROUND

Hydrocarbons are trapped in reservoirs. Wellbores are drilled through those reservoirs to raise the hydrocarbons to the surface. Sometimes, additional equipment like pumps are used to raise the hydrocarbons to the surface.

SUMMARY

This disclosure describes technologies related to lubricating an electric submersible pump assembly. Implementations of the present disclosure include an electric submersible pump assembly. The assembly includes an electric submersible pump disposed in a wellbore. The electric submersible pump assembly includes a pump to pressurize a wellbore fluid. The electric submersible pump assembly includes an electric motor coupled to the pump to rotate the pump. The electric motor is lubricated by a dielectric oil.

The electric submersible pump assembly includes a sensor coupled to the electric motor to sense a condition of the electric motor and transmit a signal including a value representing the condition. The condition that the sensor senses can be a conductivity of the dielectric oil. The sensor can be a receiver coil to contact the dielectric oil that lubricates the electric motor. A self-inductance of the receiver coil can change responsive to a change in the conductivity of the dielectric oil contacting the receiver coil. The sensor can be a first inductor and a second inductor. The sensor can sense an eddy current loss between the first inductor and the second inductor in the presence of the contaminated dielectric oil. An electric current with the first inductor can alternate at a value between 100 kHz and 100 MHz to generate a magnetic field.

The assembly includes a controller coupled to the electric motor and the sensor. The controller receives the signal including the value from the sensor and compares the value of the condition of the dielectric oil to a threshold value. The threshold value can indicate that the wellbore fluid has flowed by the seal and mixed with the dielectric oil to create the contaminated dielectric oil. The controller determines when the value of the condition of the dielectric oil is greater than the threshold value. Responsive to determining that the value included in the signal is greater than a threshold value indicating a presence of contaminated dielectric oil, the controller flows a clean dielectric oil from an accumulator to the electric motor to expel the contaminated dielectric oil out of the electric motor.

In some implementations, the electric submersible pump assembly further includes a seal coupled to and disposed between the pump and the electric motor. The seal prevents a wellbore fluid from the wellbore entering into the electric motor and mixing with the dielectric oil. Where the electrical submersible pump assembly includes the seal, the controller flows the clean dielectric oil from the accumulator to the electric motor to expel the contaminated dielectric oil out of the electric motor by the seal into the wellbore.

The accumulator includes a body to hold the clean dielectric oil. The accumulator includes a piston movably positioned within the body. The piston forces the clean dielectric oil into the electric motor. The accumulator includes a spring positioned within the body and coupled to the piston. The spring expands to move the piston. The accumulator includes a valve coupled to the body. The valve controls the flow of the clean dielectric oil from the accumulator to the electric motor.

Further implementations of the present disclosure include a method for lubricating an electric submersible pump motor. The method includes sensing, by a sensor coupled to an electric submersible pump assembly positioned in a wellbore, a condition of a dielectric oil that lubricates the electric submersible pump assembly. Where the condition of the dielectric oil is a conductivity of the dielectric oil, sensing the condition of the dielectric oil includes sensing the conductivity of the dielectric oil.

In some implementations, the electric submersible pump assembly includes a pump to pressurize the wellbore fluid. The electric submersible pump includes an electric motor to rotate the pump. The electric motor is lubricated by the dielectric oil. The electric submersible pump assembly includes a seal coupled to and disposed between the pump and the electric motor. The seal prevents the wellbore fluid from the wellbore from entering into the electric motor and mixing with the dielectric oil. Where the electric submersible pump assembly includes the pump, the electric motor, and the seal, sensing the condition of the dielectric oil within the electric submersible pump assembly includes sensing the condition of the dielectric oil in the electric motor.

In some implementations, where the sensor includes a receiver coil to contact the dielectric oil that lubricates the electric motor, a self-inductance of the receiver coil changes responsive to a change in the conductivity of the dielectric oil contacting the receiver coil. Sensing, by the sensor coupled to the electric submersible pump assembly positioned in the wellbore, the condition of the dielectric oil that lubricates the electric motor includes sensing the self-inductance of the receiver coil changing responsive to the change in the conductivity of the dielectric oil contacting the receiver coil.

In some implementations, where the sensor includes a first inductor and a second inductor, the sensor senses an eddy current loss between the first inductor and the second inductor in a presence of the contaminated dielectric oil. Sensing the condition of the dielectric oil in the electric motor can include sensing the eddy current loss between the first inductor and the second inductor.

Sensing the condition of the dielectric oil in the electric motor with the first inductor and the second inductor can include generating a magnetic field by the first inductor and receiving the magnetic field at the second inductor. Generating the magnetic field by the first inductor can further include flowing an electric current to the first inductor by the controller and responsive to flowing the electric current to the first inductor, generating the magnetic field with the first inductor. Flowing the electric current to the first inductor can include alternating the electric current at a value between 100 kHz and 100 MHz.

The method includes transmitting, by the sensor to a controller, a signal including a value representing the condition of the dielectric oil. The method includes receiving, at the controller, the signal including the value representing the condition of the dielectric oil. The method includes comparing, by the controller, the value to a threshold value that indicates that a wellbore fluid has flowed into the electric submersible pump assembly and contaminated the dielectric oil. The threshold value can indicate that the wellbore fluid has flowed by the seal and mixed with the dielectric oil to create the contaminated dielectric oil. The method includes responsive to the comparison, determining, by the controller, that the value is greater than the threshold value.

The method includes responsive to determining that the value is greater than the threshold value, flowing, by the controller, a clean dielectric oil from an accumulator into the electric submersible pump assembly to expel the contaminated dielectric oil out of the electric submersible pump assembly into the wellbore. Flowing, by the controller, the clean dielectric oil from the accumulator into the electric submersible pump assembly to expel the contaminated dielectric oil out of the electric submersible pump assembly into the wellbore further can include flowing, by the controller, the clean dielectric oil from the accumulator to the electric motor to expel the contaminated dielectric oil out of the electric motor by the seal into the wellbore.

In some implementations, flowing the clean dielectric oil from an accumulator to the electric motor further includes holding the clean dielectric oil in a body of the accumulator, actuating a valve coupled to the body to allow a flow of the clean dielectric oil from the accumulator to the electric motor, responsive to actuating the valve to allow the flow of the clean dielectric oil from the accumulator to the electric motor, expanding a spring positioned within the body. Responsive to expanding the spring, the method includes moving a piston within the body. Responsive to moving the piston within the body, the method includes forcing the clean dielectric oil into the electric motor. Responsive to forcing the clean dielectric oil into the electric motor, the method includes expelling the contaminated oil out of the electric submersible pump assembly by the seal into the wellbore.

In some implementations, the method further includes transmitting, by the controller, a status signal representing the condition of the electric submersible pump assembly to a remote operating station.

The details of one or more implementations of the subject matter described in this disclosure are set forth in the accompanying drawings and the description below. Other features, aspects, and advantages of the subject matter will become apparent from the description, the drawings, and the claims.

BRIEF DESCRIPTION OF THE DRAWINGS

Like reference numbers and designations in the various drawings indicate like elements.

DETAILED DESCRIPTION

Figure 1:
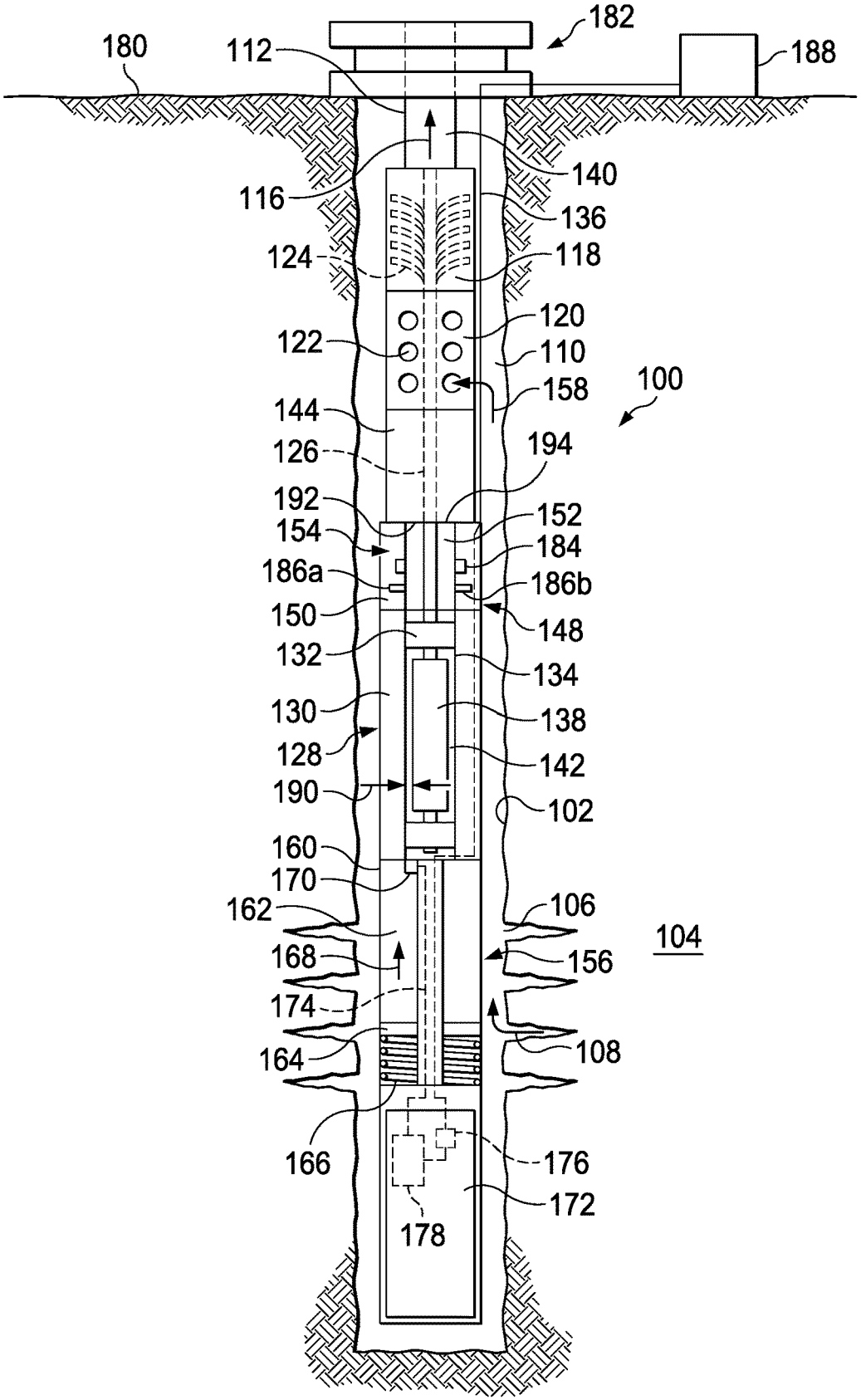
FIG. 1 is a schematic view of an electric submersible pump assembly disposed in a wellbore.

The present disclosure describes an assembly and a method for lubricating an electric submersible pump assembly. Wellbores in an oil and gas well are filled with both liquid and gaseous phases of various fluids and chemicals including water, oils, and hydrocarbon gases. An electric submersible pump is installed in the wellbore to pressurize the fluids and gases in the wellbore from the formations of the Earth to flow the fluids and gas from the wellbore to the surface of the Earth. The electric submersible pump assembly includes a pump to pressurize a wellbore fluid. The electric submersible pump includes an electric motor coupled to the pump to rotate the pump. The electric motor is lubricated by a dielectric oil. The electric submersible pump assembly includes a seal coupled to and disposed between the pump and the electric motor. The seal prevents the fluids and gases from the wellbore from entering into the electric motor and mixing with the dielectric oil.

The electric submersible pump assembly includes a lubricator assembly. The electrical submersible pump assembly is disposed in the wellbore. The lubricator assembly includes a sensor coupled to the electric motor. The sensor senses a condition of the electric motor, for example, a property of a dielectric oil within the electric motor, and transmits a signal representing the property of the dielectric oil to a controller. The controller receives the signal from the sensor and then compares the value of the property of the dielectric oil to a threshold value of the property of the dielectric oil. The threshold value of the property of the dielectric oil, for example, is a value of a the property of the dielectric oil which indicates a presence of contaminated dielectric oil, that is, the wellbore fluid has leaked by the seal and into the motor, contaminating the dielectric oil. The controller then determines when the value of the property of the dielectric oil is less than the threshold value of the property of the dielectric oil. Responsive to the controller determining when the value of the property of the dielectric oil is less than the threshold value of the property of the dielectric oil, the controller flows clean dielectric oil from an accumulator to the electric motor to expel the contaminated dielectric oil out of the electric motor through the seal.

Implementations of the present disclosure realize one or more of the following advantages. Operating life of the electric submersible pump can be increased. For example, release of clean dielectric oil displaces conductive wellbore fluids entering the motor by a degrading or failing motor seal which can create an electrical short between motor components. Preventative and corrective maintenance conducted on electric submersible pumps can be decreased. For example, some motor components can be isolated from wellbore fluid for a longer time period, increasing component mean time between failures. Increasing the mean time between failures can increase the time period between scheduled preventive maintenance and required corrective maintenance, which will further reduce the total well cost. Reducing the total well cost can change the total well cost from a loss to a profit.

FIG. 1 is a schematic view of an electric submersible pump assembly 100 disposed in a wellbore 102. The wellbore 102 extends from the surface 180 of the Earth into the formations 104 of the Earth. The formations 104 of the Earth contain pressurized liquid and gaseous phases of various fluids and chemicals including water, oils, and hydrocarbon gases. The wellbore 102 includes openings 106 that allow the liquid and gaseous phases of the various fluids and chemicals including water, oils, and hydrocarbon gases to flow from the formations 104 into the wellbore 102 in the direction of arrow 108 and up to the surface of the Earth. A wellhead assembly 182 is mechanically coupled to the wellbore 102 to seal the wellbore fluids in the wellbore 102 and control the flow of the wellbore fluids out of the wellbore 102. The wellhead assembly 182 is positioned on the surface 180 of the Earth. The wellhead assembly 182 can be referred to as a Christmas tree. The wellhead assembly 182 can include a series of valves, chokes, spools, and fittings to control the flow of the wellbore fluids from the wellbore 102.

The assembly 100 is disposed in a wellbore 102 to pressurize the wellbore fluids. Pressurizing the wellbore fluids flows the wellbore fluids from a downhole location 110 to an uphole location 140 through a tubing 112. The uphole location 140 can be the surface 180 of the Earth in the direction of arrow 116.

The assembly 100 includes a pump 118. The pump 118 increases the pressure of the wellbore 102 at the downhole location 110 by creating a suction force to flow the wellbore fluids into a pump suction 120 through suction inlets 122 from downhole location 110 into the suction inlets 122 in the direction of arrow 158. The pump 118 is a multi-stage centrifugal pump. The pump 118 includes impellers 124. The impellers 124 rotate, increasing a pressure and velocity of the wellbore fluids. The pump 118 includes a drive shaft 126 coupled to the impellers 124. The drive shaft 126 rotates within the pump 118 to rotate the impellers 124.

The assembly 100 includes a motor 128. The motor 128 can be a rotary electro-magnetic machine. For example, the motor 128 can be a squirrel cage induction motor. The motor 128 is coupled to the drive shaft 126 to rotate the pump 118. The drive shaft 126 extends through the pump 118 and into the motor 128. The motor 128 includes a motor body 130. The motor body 130 seals the motor 128 components from the wellbore fluids. The drive shaft 126 is centered within the motor body 130 by a bearing set 132.

The motor 128 includes a stator 134. The stator 134 is positioned within the motor body 130 and coupled to the motor body 130. Electricity flows from a power source (not shown) the surface 180 of the Earth through a power cable 136 coupled to the stator 134. Electricity flowing through the stator 134 generates a magnetic field. The stator 134 can include a wire (not shown). The wire is wound around a core (not shown) to create a winding. The power source can be a renewable remote power source such as a solar panel or a commercial electrical grid. The power source can include a power storage device, for example, a battery.

The motor 128 includes a rotor 138 positioned within the stator 134. The rotor 138 is mechanically coupled to the drive shaft 126. The rotor 138 rotates in response to the magnetic field generated by the stator 134. As the rotor 138 rotates in response to the magnetic field, the drive shaft 126 rotates, causing the impellers 124 to rotate and wellbore 102 fluid to flow.

The motor body 130 and the stator coupled to the motor body 130 define a void 142. The stator 134 and the rotor 138 are positioned within the void 142. The rotor 138 is spaced from (separated from) the stator 134 by a dimension 190. The dimension 190 can be referred to as an annular clearance or a stator 134/rotor 138 air gap. The void 142 is filled with a dielectric oil. The dielectric oil is an electrical insulator which prevents a flow of an electric current directly from the stator 134 to the rotor 138. The flow of an electric current directly from the stator to the rotor 138 is an electric short which can result in motor 128 failure. Also, the dielectric is circulated around the void 142 to lubricate and cool the rotor 138 and the bearing set 132.

The assembly 100 includes a sealing element 144. The sealing element 144 is coupled to the pump 118 and positioned in between the motor 128 and the pump 118 to prevent a flow of wellbore fluids from entering the motor body 130. The sealing element 144 is coupled to the drive shaft 126 to define a sealing surface 146 to prevent the flow of wellbore fluids from entering the motor body 130. Over time and due to wellbore 102 conditions, the structural integrity of the sealing element 144 can degrade, reducing the sealing effectiveness of the sealing element 144. The sealing element 144 can degrade due to wellbore conditions such as pressure, temperature, and/or corrosive or abrasive substances in the wellbore fluids. When sealing element 144 sealing effectiveness degrades, wellbore fluids can leak by the sealing surface 146 into the void 142 of the motor body 130. The leaked wellbore fluids can comingle with or displace the dielectric oil in the void 142. When the wellbore fluids comingle with the dielectric oil, the electric current can flow through the mixture of wellbore fluids and dielectric oil and short the stator 134 and the rotor 138, resulting in motor 128 failure. The mixture of the wellbore fluids and dielectric oil can be referred to as a contaminated dielectric oil. For example, at a portion 142 of the void 142, near location 192 where the power cable 136 electrically couples to the stator 134 the electric current can flow through the mixture of wellbore fluids and dielectric oil and short the stator 134 and the rotor 138, resulting in motor 128 failure. In some orientations and configurations, the portion 142 of the void 142 can be near a top surface 194 of the void.

The assembly 100 includes a sensor sub-assembly 148. The sensor sub-assembly 148 is coupled to the motor 128 and the sealing element 144. The sensor sub-assembly 148 senses a condition of the motor 128 and transmits a signal including a value representing the condition, for example a resistance to the flow of electricity of a motor 128 component, vibration of the motor 128, or a temperature of a motor 128 component, or a property of the dielectric oil within the motor 128. The sensor sub-assembly 148 includes a body 150. The body 150 defines a void 152. The void 152 of the sensor sub-assembly 148 is fluidically coupled to the void 142 of the motor 128. The void 152 of the sensor sub-assembly 148 is filled with the dielectric oil.

The sensor sub-assembly 148 includes a sensor 154. The sensor 154 senses a property of the dielectric oil in the void 152 of the motor 128 and transmits a signal including a value representing the property of the dielectric oil. The condition of the motor 128 can be a property of the dielectric oil. For example, the property of the dielectric oil can be a conductivity or a resistivity (or both) of the dielectric oil. Alternatively or in addition, the property of the dielectric oil can be a pressure, a temperature, or a viscosity of the dielectric oil. When the sealing element 144 degrades as previously described, wellbore fluids can leak by the sealing element 144 and into the void 152 of the motor 128 and mix with the dielectric oil in the void 152 of the motor 128. The mixing can occur at location 192 near the top surface 194 of the void 152 as previously described. The contamination of the dielectric oil by the wellbore fluids changes the property of the dielectric oil.

The sensor 154 senses the conductivity or resistivity of the contaminated dielectric oil and transmits a signal including the value of the conductivity or resistivity. For example, in reference to the conductivity of the dielectric oil, when the dielectric oil is clean (uncontaminated), the dielectric oil will have a low electrical conductivity. For example, the electrical conductivity can be low when the electrical conductivity is less than $10^{-10}$ S/m. When the dielectric oil has mixed with wellbore fluids (contaminated), the dielectric oil will have a high electrical conductivity. For example, the electrical conductivity can be high when the electrical conductivity is greater than 10'S/m. This is because the wellbore fluids, especially water and salts, have a high conductivity relative to the dielectric oil. Likewise, in reference the resistance of the dielectric oil, when the dielectric oil is clean (uncontaminated), the dielectric oil will have a high resistance. When the dielectric oil has mixed with wellbore fluids (contaminated), the dielectric oil will have a low resistance. This is because the wellbore fluids, especially water and salts, have a low resistance relative to the dielectric oil.

The sensor 154 can include a single sensor or multiple sensors. For example, three sensors can be arrayed in a plane in with 120 degrees of separation to sense the condition of the dielectric oil in the void 152.

Figure 2A:
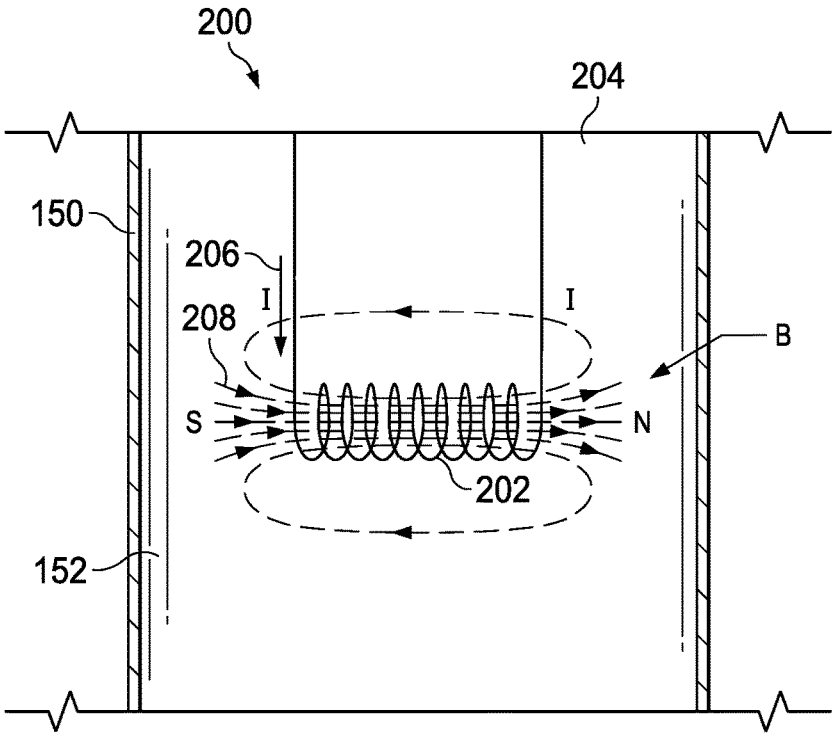
FIG. 2A is a schematic view of a one coil inductance sensor.

FIG. 2A is a schematic view of a one coil inductance sensor 200. Referring to FIG. 2A, the one coil inductance sensor 200 can be the sensor 154. The one coil inductance sensor 200 is positioned within the void 152 of the body 150 of the sensor sub-assembly 148. The one coil inductance sensor 200 includes a wire receiver coil 202. The wire receiver coil 202 contacts the dielectric oil 204. The one coil inductance sensor 200 senses a self-inductance of the wire receiver coil 202. Electricity, I, flows through the wire receiver coil 202 in the direction of arrow 206. The flow of electricity through the wire receiver coil 202 generates a magnetic field B. The magnetic field B is in the direction as shown by arrows 208, from a south magnetic pole (S) to a north magnetic pole (N). The self-inductance of the wire receiver coil 202 changes in response to a change in the conductivity of the dielectric oil 204 contacting the wire receiver coil 202. The self-inductance of the wire receiver coil 202 immersed in dielectric oil 204 is affected by the electrical conductivity of the dielectric oil 204. When the electrical conductivity decreases, the self-inductance also decreases. The change is self-inductance is constantly measured and any decrease corresponds to a loss of electrical energy to the contaminated dielectric oil. This loss is calibrated against a known amount of contamination.

Figure 2B:
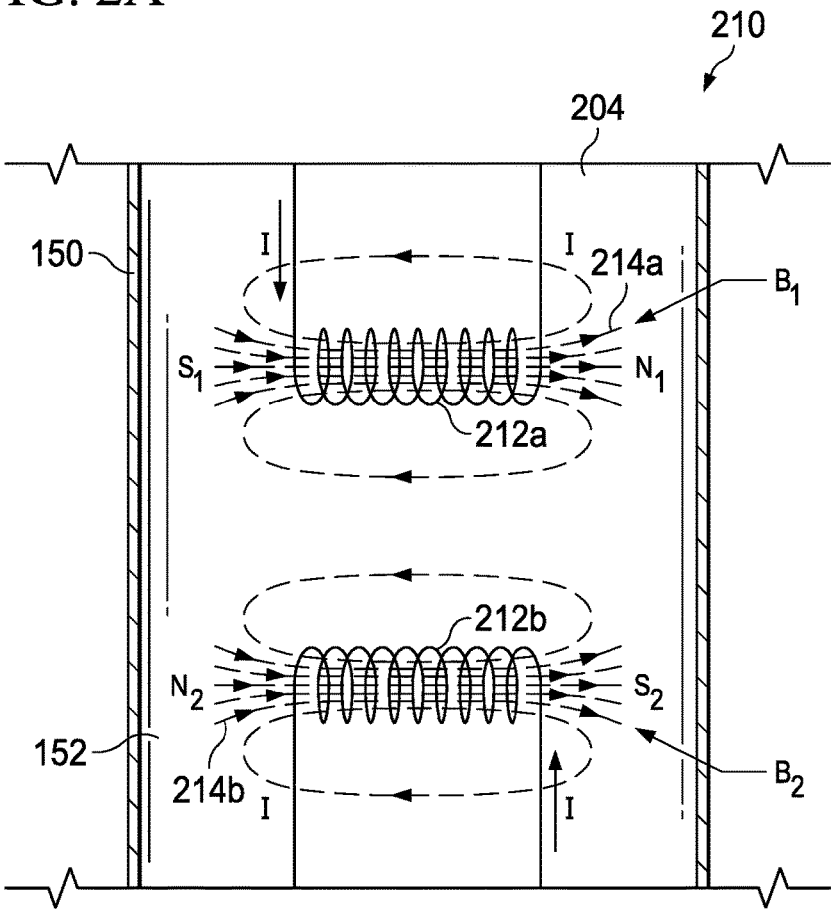
FIG. 2B is a schematic view of a two coil inductance sensor.

FIG. 2B is a schematic view of a two coil inductance sensor 208. Referring to FIG. 2B, the two coil inductance sensor 210 can be the sensor 154. The two coil inductance sensor 210 is positioned within the void 152 of the body 150 of the sensor sub-assembly 148. The two coil inductance sensor 210 includes a first wire receiver coil 212*a* and a second wire receiver coil 212*b*. The wire receiver coils 212*a* and 212*b* contact the dielectric oil 204. The two coil inductance sensor 208 senses a mutual-inductance.

Electricity, I, flows through the wire receiver coils 212*a* and 212*b* in the direction of arrows 212*a* and 212*b*, respectively. The flow of electricity through the wire receiver coil 210*a* generates a magnetic field $B_1$. The magnetic field $B_1$ is in the direction of arrows 214*a*, from a south magnetic pole ($S_1$) to a north magnetic pole ($N_1$). The flow of electricity through the wire receiver coil 210*b* generates a magnetic field $B_2$. The magnetic field $B_2$ is in the direction of arrows 214*b*, from a south magnetic pole ($S_2$) to a north magnetic pole ($N_2$).

The mutual inductance between the wire receiver coils 212*a* and 212*b* is affected by the electrical conductivity of the dielectric oil between them. The lower the electrical conductivity, lower the electrical losses. The electrical loss is measured as the electrical power in wire receiver coil 212*a* minus the electrical power received in wire receiver coil 212*b*. This electrical loss is calibrated against a known amount of contamination.

The magnetic field $B_1$ induces eddy currents in the dielectric oil 204 which weaken the magnetic field across the void 152. The second wire receiver coil 212*b* receives the weakened magnetic field, and measures the weakened magnetic field by generating an induced electric current proportional to the received weakened magnetic field. The difference between the transmitted magnetic field and the received weakened magnetic field corresponds to the eddy current loss in the dielectric oil. When the wellbore fluids mix with the clean dielectric oil in the void 152 to create the contaminated dielectric oil, the conductivity of the dielectric oil increases from the original value of conductivity of the clean dielectric oil. The increase in conductivity in the contaminated dielectric oil causes the magnetic field to induce greater eddy currents, further weakening the magnetic field received at the second wire receiver coil 212*b* relative to the weakened magnetic field in clean dielectric oil. An electric current generating the magnetic field with the first wire receiver coil 212*a* can alternate at a value between 100 kHz and 100 MHz.

The assembly 100 includes an accumulator 156. The accumulator 156 is coupled to the motor 128. The accumulator 156 contains an uncontaminated (clean) dielectric oil. The accumulator 156 flows the uncontaminated dielectric oil to the motor 128. The accumulator 156 includes a body 160 defining a void 162. The body 160 holds the clean dielectric oil. The void 162 is filled with the clean dielectric oil. The accumulator 156 includes a piston 164. The piston 164 is movably positioned within the body 160 of the accumulator 156. The piston 164 forces the clean dielectric oil into the motor 128. The accumulator 156 includes a spring 166. The spring 166 is positioned within the body 160 and coupled to the body 160 and the piston 164. The spring 166 expands to move the piston 164 to force the clean dielectric oil in the direction of arrow 168.

The accumulator 156 includes a valve 170. The valve 170 is coupled to the body 160 of the accumulator 156 and the motor 128. The valve 170 controls the flow of the clean dielectric oil from the accumulator 156 to the motor 128. When in a closed position (not shown), the valve 170 prevents flow of the clean dielectric oil from the accumulator 156 to the motor 128. The closed position is the normal position of the valve 170. When in an open position (not shown), the valve 170 allows flow of the clean dielectric oil from the accumulator 156 to the motor 128.

The assembly 100 includes a controller 172. The structural details of the controller 172 are described below. The controller 172 is operatively coupled to the motor 128, the sensor 154, and the accumulator 156. The controller 172 is coupled to motor 128 and the sensor 154 by the power cable 136. The power cable 136 can include a control cable. The controller 172 receives the signal including the value of the conductivity of the dielectric oil in the void 152 of the sensor sub-assembly 148 through the control cable. Additionally or alternatively, the controller 172 can receive the signal including the value of the conductivity of the dielectric oil in the void 152 of the sensor sub-assembly 148 from an addressable inductive coupling (not shown) positioned on the power cable 136 which can transfer electrical power and data to and from the sensor 154.

The controller 172 is operatively coupled to valve 170 of the accumulator 156 by a control cable 174. The controller 172 generates a command signal to move the valve 170 from the closed position preventing flow of the clean dielectric oil from the accumulator 156 to the motor 128 to the open position allowing flow of the clean dielectric oil from the accumulator 156 to the motor 128.

The controller 172 receives the signal including the value of the conductivity of the dielectric oil in the void 152 of the sensor sub-assembly 148 from the sensor 154. The controller 172 compares the value of the conductivity of the dielectric oil in the void 152 to a threshold value stored in the controller 172. The threshold value is a value of conductivity which indicates a presence of contaminated dielectric oil in the void 152. The threshold value is a value of conductivity above which the motor functions normally. The threshold value corresponds to a minimum dielectric strength of the dielectric oil. In other words, the wellbore fluids have leaked by the sealing element 144 and into the sensor sub-assembly 148, mixing with the clean dielectric oil. The controller 172 determines when the value of the conductivity of the dielectric oil in the void 152 is greater (a high conductivity) than the threshold value.

Responsive to determining that the value of the conductivity of the dielectric oil in the void 152 is greater than the threshold value (indicating a presence of contaminated dielectric oil), the controller 172 flows clean dielectric oil from the accumulator 156 to the motor 128 to expel the contaminated dielectric oil out of the motor 128 back by the leaking seal element 144. In other words, the contaminated dielectric oil is expelled back out via the route it entered into the void 152. Clean dielectric oil can flow from the accumulator 156 until the accumulator no longer contains clean dielectric oil. As seen, flowing the clean dielectric oil to the leaking seal element 144 is not a permanent correction to fix the leaking seal element 144. The flow of clean dielectric oil from the accumulator can alert the user that the seal element 144 has an integrity problem, which can lead to assembly 100 electrical failure. In some cases, the controller 172 can flow clean dielectric oil from the accumulator 156 to the motor 128 for a pre-set time to expel some or all of the contaminated dielectric oil out of the motor 128 back by the leaking seal element 144 as previously described.

As described earlier, the controller 172 generates the command signal to move the valve 170 from the closed position preventing flow of the clean dielectric oil from the accumulator 156 to the motor 128 to the open position for a pre-set time allowing flow of the clean dielectric oil from the accumulator 156 to the motor 128. This process is repeated as required until the oil accumulator 156 is empty. The controller can determine that the accumulator 156 is empty by using a known number of times the valve 170 has been actuated multiplied by the pre-set time to equal the volume of dielectric oil flowed from the accumulator 156. In other words, only a pre-set number of actuations can be achieve based on accumulator volume and the pre-set flow time. The controller 178 will count-down the valve 170 actuations. The controller 178 transmits number of valve actuations to the user. The controller 178 monitors the conductivity of the dielectric oil between each actuation for a finite amount of time to determine if the valve 170 should be actuated again to restore the conductivity below the threshold value.

The sensor 154 periodically senses the conductivity of the dielectric oil in the void 152 of the sensor sub-assembly 148 and transmits the signals including the value of the conductivity to the controller 172. Sensing the conductivity of the dielectric oil can include a time interval between sensing the conductivity. For example, the sensor can sense the conductivity every one second, five seconds, or ten seconds. The time interval can be adjustable. The controller 172 continues to compare the value of the conductivity of the dielectric oil in the void 152 to the threshold value. The controller 172 determines when the value of the conductivity of the dielectric oil in the void 152 is less than the threshold value by continually sampling the conductivity of the dielectric oil. In some cases, the controller 172 will not actuate the valve 170 again until the conductivity of the dielectric oil rises above the threshold value, that is, the dielectric oil is more conductive (has a lower insulation value).

The controller 172 includes a computer 178 with a microprocessor. The controller 172 has one or more sets of programmed instructions stored in a memory or other non-transitory computer-readable media that stores data (e.g., connected with the printed circuit board), which can be accessed and processed by a microprocessor. The programmed instructions can include, for example, instructions for sending or receiving signals and commands to operate the valve 170 and/or collect and store data from the sensor 154. The controller 172 stores values (signals and commands) against which sensed values (signals and commands) representing the condition are compared.

The controller 172 includes a telemetry transceiver 176. The telemetry transceiver 176 transmits a status signal to a remote control station 188. The remote control station 188 can be an operating station at the surface 180 of the Earth which receives the reprogramming signal through the wellbore and or the power cable 136. For example, the number of times the valve 170 has been actuated for the pre-set time and/or the balance of actuations remaining.

The telemetry transceiver 176 also receives a command signal from the remote control station 188. For example, command signal can instruct the one or more computer processors to open or close the valve 170 for the pre-set time.

Figure 3:
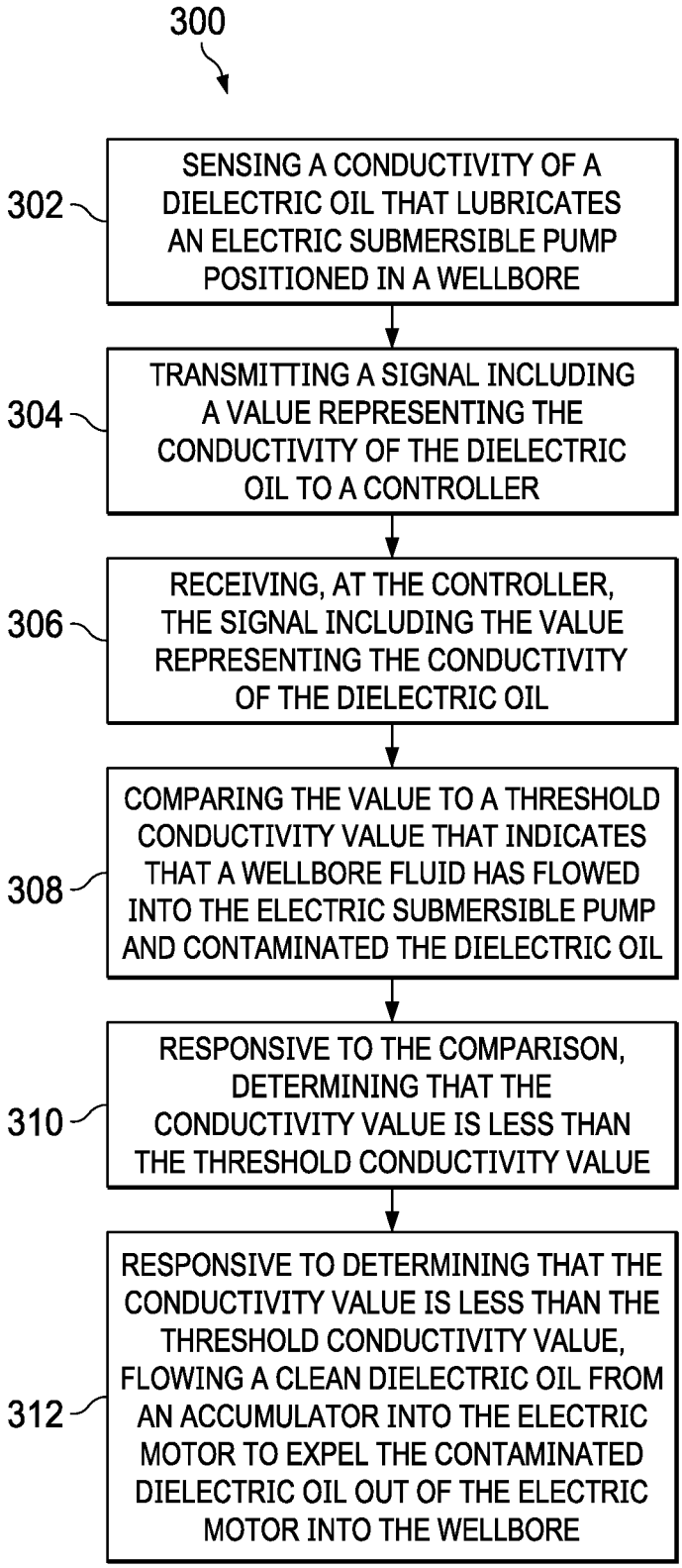
FIG. 3 is a flow chart of an example method of lubricating an electric submersible pump according to the implementations of the present disclosure.

FIG. 3 is a flow chart of an example method 300 of lubricating an electric submersible pump according to the implementations of the present disclosure. A dielectric oil in the electric submersible pump is refreshed. The electric submersible pump operates in a subterranean oil or water well. At 302, a condition of a dielectric oil that lubricates the electric submersible pump is sensed by a sensor coupled to an electric submersible pump positioned in a wellbore. The dielectric oil also cools the electric submersible pump.

The electric submersible pump can include a pump, an electric motor, and a seal. The pump, driven by the electric motor, adds energy to the fluid in the well bore and lifts fluids to surface. The electric motor is lubricated and cooled by the dielectric oil. The seal is coupled to and disposed between the pump and the electric motor. The seal prevents the wellbore fluid from the wellbore from entering into the electric motor and mixing with the dielectric oil. When the electric submersible pump includes the pump, the electric motor, and the seal, sensing the condition of the dielectric oil within the electric submersible pump includes sensing the condition of the dielectric oil in the electric motor.

The condition of the dielectric oil can be a conductivity of the dielectric oil. When the condition of the dielectric oil is the conductivity of the dielectric oil, sensing the condition of the dielectric oil includes sensing the conductivity of the dielectric oil.

The sensor can include a receiver coil to contact the dielectric oil that lubricates the electric submersible pump motor. A self-inductance of the receiver coil changes responsive to a change in the conductivity of the dielectric oil contacting the receiver coil. When the sensor includes the receiver coil, sensing, by the sensor coupled to the electric submersible pump positioned in the wellbore, the condition of the dielectric oil that lubricates and cools the electric submersible pump motor includes sensing the self-inductance of the receiver coil changing responsive to the change in the conductivity of the dielectric oil contacting the receiver coil.

The sensor can include a first inductor and a second inductor to sense an eddy current loss between the first inductor and the second inductor in a presence of the contaminated dielectric oil. When the sensor includes the first inductor and the second inductor, sensing the condition of the dielectric oil in the electric submersible pump includes sensing the eddy current loss between the first inductor and the second inductor. The method can include generating, by the first inductor, a magnetic field. Generating, by the first inductor, the magnetic field, can include flowing, by the controller, an electric current to the first inductor and responsive to flowing the electric current to the first inductor, generating the magnetic field with the first inductor. Flowing the electric current to the first inductor can include alternating the electric current at a value between 100 kHz and 100 MHz. The method can include receiving, at the second inductor, the magnetic field.

At 304, a signal including a value representing the condition of the dielectric oil is transmitted by the sensor to the controller.

At 306, the signal including the value representing the condition of the dielectric oil is received at the controller.

At 308, the value is compared, by the controller, to a threshold value that indicates that a wellbore fluid has flowed into the electric submersible pump and contaminated the dielectric oil. The threshold value can indicated that the wellbore fluid has flowed by the seal and mixed with the dielectric oil to create the contaminated dielectric oil. When the seal/protector integrity is broached, well bore fluids will enter the top surface 194 of the motor 128 and reduces the electrical dielectric quality of the dielectric oil in the motor 128, for example at location 192.

At 310, responsive to the comparison, it is determined, by the controller, that the value is greater than the threshold value.

At 312, responsive to determining that the value is greater than the threshold value, a clean dielectric oil is flowed, by the controller, from an accumulator into the electric submersible pump to expel the contaminated dielectric oil out of the electric submersible pump into the wellbore. Flowing, by the controller, the clean dielectric oil from the accumulator into the electric submersible pump to expel the contaminated dielectric oil out of the electric submersible pump into the wellbore further can include flowing, by the controller, the clean dielectric oil from the accumulator to the electric motor to expel the contaminated dielectric oil out of the electric motor back through the seal, by the sealing surface 146, into the wellbore. The controller 178 opens or closes the valve 170 to flow the clean dielectric oil to the motor 128 for the time interval. The controller 178 counts the number of valve 170 actuations. When there is no clean dielectric oil remaining, the controller 178 will no longer actuate the valve 170, in other words, when there is no longer a positive number of actuations remaining. In some cases, the user in the remote operating station 188 is on the surface 180 of the Earth can manually actuate the valve 170 to ensure all the clean dielectric oil in the accumulator 156 has been expelled.

Flowing the clean dielectric oil from an accumulator to the electric submersible pump further can include holding the clean dielectric oil in a body of the accumulator. Flowing the clean dielectric oil from an accumulator to the electric submersible pump further can include actuating a valve coupled to the body to allow a flow of the clean dielectric oil from the accumulator to the electric submersible pump. Flowing the clean dielectric oil from an accumulator to the electric submersible pump further can include responsive to actuating the valve to allow the flow of the clean dielectric oil from the accumulator to the electric submersible pump, expanding a spring positioned within the body. Flowing the clean dielectric oil from an accumulator to the electric submersible pump further can include responsive to expanding the spring, moving a piston within the body. Flowing the clean dielectric oil from an accumulator to the electric submersible pump further can include responsive to moving the piston within the body, forcing the clean dielectric oil into the electric submersible pump. Flowing the clean dielectric oil from an accumulator to the electric submersible pump further can include responsive to forcing the clean dielectric oil into the electric submersible pump, expelling the contaminated oil out of the electric submersible pump by the seal into the wellbore.

The method can further include transmitting, by the controller, a status signal representing the condition of the electric submersible pump to a remote operating station. The remote operating station 188 is on the surface 180 of the Earth.

Although the following detailed description contains many specific details for purposes of illustration, it is understood that one of ordinary skill in the art will appreciate that many examples, variations, and alterations to the following details are within the scope and spirit of the disclosure. Accordingly, the example implementations described herein and provided in the appended figures are set forth without any loss of generality, and without imposing limitations on the claimed implementations.

Although the present implementations have been described in detail, it should be understood that various changes, substitutions, and alterations can be made hereupon without departing from the principle and scope of the disclosure. Accordingly, the scope of the present disclosure should be determined by the following claims and their appropriate legal equivalents.

The invention claimed is:

1. An assembly comprising:

an electric submersible pump configured to be disposed in a wellbore, the electric submersible pump comprising:

a pump configured to pressurize a wellbore fluid;

an electric motor coupled to the pump and configured to rotate the pump, the electric motor lubricated by a dielectric oil; and a seal coupled to and disposed between the pump and the electric motor, the seal configured to prevent a wellbore fluid from the wellbore to enter into the electric motor and mix with the dielectric oil in the electric motor;

a sensor sub-assembly comprising one or more sensors, the sensor sub-assembly coupled to the electric motor and the seal between the electric motor and the seal, the one or more sensors configured to sense a condition of the dielectric oil in the electric motor and transmit a signal including a value representing the condition; and a controller coupled to the electric motor and the one or more sensors, the controller configured to:

receive the signal including the value from the one or more sensors;

compare the value of the condition of the dielectric oil to a threshold value;

determine when the value of the condition of the dielectric oil is greater than the threshold value; and responsive to determining that the value included in the signal is greater than a threshold value indicating a presence of contaminated dielectric oil, flow a clean dielectric oil from an accumulator to the electric motor to expel the contaminated dielectric oil out of the electric motor by the sensor sub-assembly and the seal into the wellbore.

2. The assembly of claim 1, wherein the threshold value indicates that the wellbore fluid has flowed by the seal and the sensor sub-assembly and mixed with the dielectric oil to create the contaminated dielectric oil.

3. The assembly of claim 1, wherein the condition comprises a conductivity of the dielectric oil.

4. An assembly comprising:

an electric submersible pump configured to be disposed in a wellbore, the electric submersible pump comprising:

a pump configured to pressurize a wellbore fluid;

an electric motor coupled to the pump and configured to rotate the pump, the electric motor lubricated by a dielectric oil; and a seal coupled to and disposed between the pump and the electric motor, the seal configured to prevent a wellbore fluid from the wellbore to enter into the electric motor and mix with the dielectric oil in the electric motor;

a sensor coupled to the electric motor and configured to sense a condition of the dielectric oil in the electric motor and transmit a signal including a value representing the condition, the sensor comprising a receiver coil, the receiver coil directly in contact with the dielectric oil that lubricates the electric motor, wherein a self-inductance of the receiver coil is configured to change responsive to a change in conductivity of the dielectric oil contacting the receiver coil; and a controller coupled to the electric motor and the sensor, the controller configured to:

receive the signal including the value from the sensor;

compare the value of the condition of the dielectric oil to a threshold value;

determine when the value of the condition of the dielectric oil is greater than the threshold value; and responsive to determining that the value included in the signal is greater than a threshold value indicating a presence of contaminated dielectric oil, flow a clean dielectric oil from an accumulator to the electric motor to expel the contaminated dielectric oil out of the electric motor by the seal into the wellbore.

5. The assembly of claim 4, wherein the accumulator comprises:

a body configured to hold the clean dielectric oil;

a piston movably positioned within the body, the piston configured to force the clean dielectric oil into the electric motor;

a spring positioned within the body and coupled to the piston, the spring configured to expand to move the piston; and a valve coupled to the body, the valve configured to control a flow of the clean dielectric oil from the accumulator to the electric motor.

6. The assembly of claim 4, wherein the controller is further configured to transmit a status signal representing the condition of the electric motor to a remote operating station.

7. A method comprising:

sensing, by directly contacting a dielectric oil lubricating an electric motor of an electric submersible pump assembly with a receiver coil of a sensor, a change in a self-inductance of the receiver coil;

transmitting a signal including a value representing the change in the self-inductance of the receiver coil;

receiving the signal including the value from the sensor at a controller operatively coupled to the electric motor and the sensor;

comparing the value of the change in the self-inductance of the receiver coil to a threshold change value of the self-inductance of the receiver coil;

based on a result of the comparison, determining when the value of the change of the self-inductance of the receiver coil of the dielectric oil is greater than the threshold change value; and responsive to determining that the value representing the change in the self-inductance of the receiver coil is greater than the threshold change value indicating a presence of contaminated dielectric oil, flowing a clean dielectric oil to the electric motor.

8. The method of claim 7, wherein the self-inductance of the receiver coil is configured to change responsive to a change in conductivity of the dielectric oil contacting the receiver coil.

9. The method of claim 7, further comprising, responsive to flowing the clean dielectric oil to the electric motor, expelling the contaminated dielectric oil out of the electric motor by a seal into the wellbore.

10. The method of claim 7, wherein flowing the clean dielectric oil to the electric motor comprises flowing the clean dielectric oil from an accumulator to the electric motor.

11. The method of claim 10, wherein flowing the clean dielectric oil from the accumulator to the electric motor comprises:

holding the clean dielectric oil in a body of the accumulator;

actuating a valve coupled to the body to allow a flow of the clean dielectric oil from the accumulator to the electric motor;

responsive to actuating the valve to allow the flow of the clean dielectric oil from the accumulator to the electric motor, expanding a spring positioned within the body;

responsive to expanding the spring, moving a piston within the body; and responsive to moving the piston within the body, forcing the clean dielectric oil into the electric motor.

12. The method of claim 7, further comprising:

rotating a pump of the electric submersible pump assembly; and responsive to rotating the pump of the electric submersible pump assembly, pressurizing a wellbore fluid within the pump.

13. The method of claim 12, further comprising, sealing between the pump and the electric motor to prevent a wellbore fluid from the wellbore entering into the electric motor and mix with the dielectric oil in the electric motor.

14. The method of claim 7, wherein the value of the change in the self-inductance of the receiver coil greater than the threshold change value indicates that the wellbore fluid has flowed by a seal and mixed with the dielectric oil in contact with the sensor to create the contaminated dielectric oil.

15. The method of claim 7, wherein the change in the self-inductance of the receiver coil indicates a change in the conductivity of the dielectric oil.

* * * * *